United States Patent [19]

Hosoya

[11] Patent Number: 4,504,819

[45] Date of Patent: Mar. 12, 1985

[54] ALARM SYSTEM FOR SIGNALING HARMFUL DROPS IN OR LOW LEVELS OF ENGINE OIL PRESSURE

[75] Inventor: Katsumi Hosoya, Yokohama, Japan

[73] Assignee: Nissan Motor Company, Limited, Japan

[21] Appl. No.: 428,224

[22] Filed: Sep. 29, 1982

[30] Foreign Application Priority Data

Nov. 4, 1981 [JP] Japan ..... 56-176744

[51] Int. Cl.[3] ..... F01M 1/00; G08B 21/00

[52] U.S. Cl. ..... 340/60

[58] Field of Search ..... 340/60, 611, 626; 307/118; 73/861.44

[56] References Cited

U.S. PATENT DOCUMENTS 4,059,087 11/1977 Tanigami et al. ..... 340/626

4,328,480 5/1982 Keitel .

*Primary Examiner*—John W. Caldwell, Sr.

*Assistant Examiner*—Ellwood G. Harding, Jr.

*Attorney, Agent, or Firm*—Lowe, King, Price & Becker

[57] ABSTRACT

An alarm system applied to engine oil pressure dependent on engine speed includes first and second sensors. The first sensor detects the engine oil pressure and generates a signal indicative thereof. The second sensor detects the engine speed and generates a signal indicative thereof. A reference signal is produced in response to the engine speed signal for defining an oil pressure reference level dependent on the engine speed. A comparator, responsive to the oil pressure signal and the reference signal, compares the engine oil pressure to the reference level and generates an alarm signal when the engine oil pressure is lower than the reference level.

12 Claims, 5 Drawing Figures

60
READ ENGINE SPEED Erpm
OIL PRESS. Pr
61
E = αErpm + (1-α)E
62
E : Erpm
E ≧ Erpm
63
VF = Erpm
E < Erpm
VF = E
64
65
VF : VFL
VF < VFL
VF ≧ VFL
67
VF > VFH
VF : VFH
VF = VFL
66
VF = VFH
68
VF ≦ VFH
69
VF : Pr
VF > Pr
VF ≦ Pr
70
71
CONTROL DRIVER TO DE-ENERGIZE INDICATOR
CONTROL DRIVER TO ENERGIZE INDICATOR

ALARM SYSTEM FOR SIGNALING HARMFUL DROPS IN OR LOW LEVELS OF ENGINE OIL PRESSURE

BACKGROUND OF THE INVENTION

1. Field of the Invention

This invention relates to an alarm system which generates an alarm signal when engine oil pressure drops excessively or is harmfully low.

2. Description of the Prior Art

Engines indispensably need lubricating systems mainly to achieve smooth and efficient operation and also to minimize wear in engine moving parts. The lubricating systems use engine oil as a lubricant. A short supply of engine oil increases the resistance to motion among engine parts in contact with one another, thereby degrading engine efficiency and increasing wear on the engine parts.

It is known to equip the engine with an alarm device which generates an alarm signal when engine oil pressure drops below a constant reference level representing an insufficient supply of engine oil. The engine oil pressure is sensed at some point along an oil line connecting the outlet of an oil pump to engine moving parts. Since the oil pump is generally driven by the engine, the engine oil pressure essentially rises according to engine rotational speed. Accordingly, the constant reference level is chosen so that an alarm signal can always indicate a short supply of engine oil even when the engine is idling, that is, when engine rotational speed is low.

Generally, the higher the engine rotational speed, the greater the required supply of engine oil. In such an alarm device, there is, consequently, a problem that no alarm signal will be generated when the supply of engine oil drops just below the required level in the high engine speed range.

SUMMARY OF THE INVENTION

It is an object of this invention to provide a more reliable alarm system for signaling harmful drops in or low levels of engine oil pressure.

In accordance with this invention, an alarm system applied to engine oil pressure dependent on engine speed includes first and second sensors. The first sensor detects the engine oil pressure and generates a signal indicative thereof. The second sensor detects the engine speed and generates a signal indicative thereof. A reference signal is produced in response to the engine speed signal for defining an oil pressure reference level dependent on the engine speed. A comparator, responsive to the oil pressure signal and the reference signal, compares the engine oil pressure to the reference level and generates an alarm signal when the engine oil pressure is lower than the reference level.

The above and other objects, features and advantages of this invention will be apparent from the following description of preferred embodiments thereof, taken in conjunction with the drawings.

BRIEF DESCRIPTION OF THE DRAWINGS

Like reference numerals denote like parts throughout the drawings.

DESCRIPTION OF THE PREFERRED EMBODIMENTS

Figure 1:
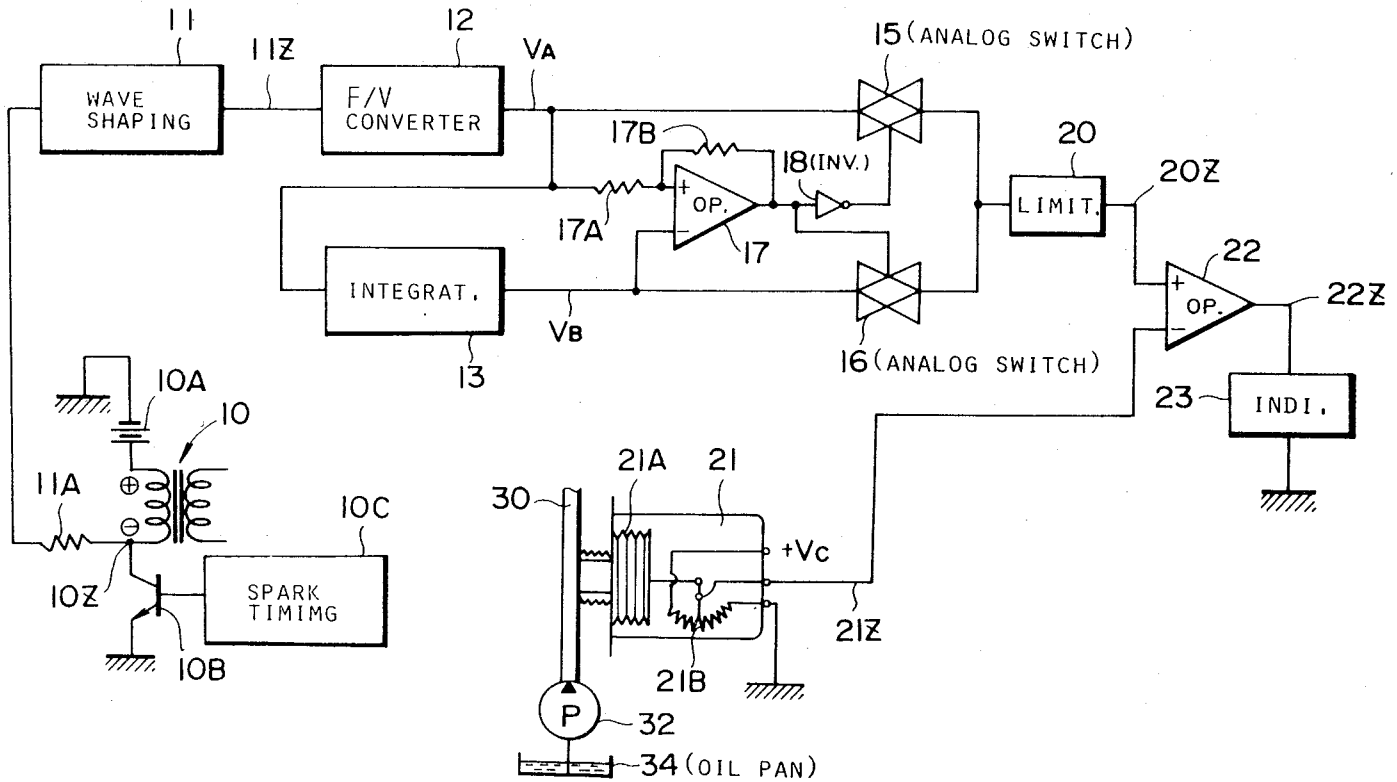
FIG. 1 is a schematic diagram of an alarm system according to a first embodiment of this invention.

With reference to FIG. 1, there is shown an alarm system according to a first embodiment of this invention. The alarm system includes an engine ignition coil 10, a wave shaping circuit 11, and a frequency-to-voltage (F/V) converter 12.

Figure 2:
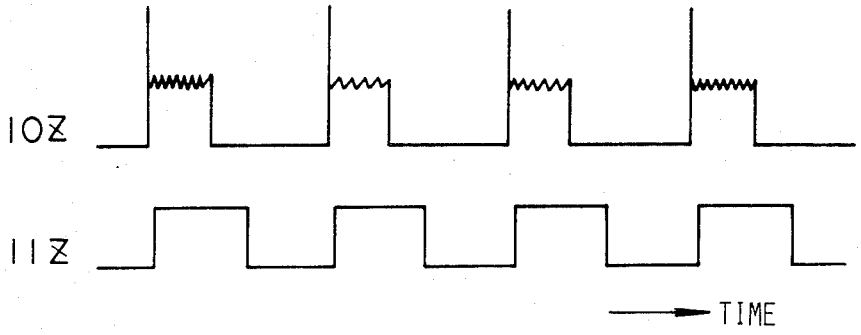
FIG. 2 is a timing chart showing waveforms of voltages at an engine ignition coil and at the output terminal of a wave shaping circuit of FIG. 1.

A DC power source 10A is connected across the primary winding of the ignition coil 10 through a switching transistor 10B. A well-known spark timing control circuit 10C controls the switching transistor 10B in response to engine camshaft or crankshaft rotation so as to intermittently cut off the current through the primary winding at a frequency proportional to that of engine camshaft or crankshaft rotation. As a result, the voltage 10Z at the junction of the ignition coil 10 and the transistor 10B is essentially in the form of a pulse train whose frequency is proportional to engine camshaft or crankshaft rotation, as shown in FIG. 2. Practically, however, the ignition coil pulse signal 10Z is slightly ragged.

The input terminal of the wave shaping circuit 11 is connected to the junction of the ignition coil 10 and the transistor 10B via a resistor 11A to receive the ignition coil pulse signal 10Z. The wave shaping circuit 11 includes a Schmitt circuit or comparator and a monostable multivibrator. The Schmitt circuit compares the voltage of the pulse signal 10Z with a reference voltage and generates a digital signal which is at the higher level only when the voltage of the pulse signal 10Z exceeds the reference voltage. In this way, the ignition coil pulse signal 10Z is shaped into a corresponding flat-edged rectangular pulse train. Triggered by rising edges of the pulses from the Schmitt circuit, the monostable multivibrator produces a constant-width pulse. In this way, the monostable multivibrator generates a rectangular pulse signal 11Z with a frequency equal to that of the ignition coil pulse signal 10Z as shown in FIG. 2. The rectangular pulse signal 11Z is conducted to an output terminal of the wave shaping circuit 11.

The input terminal of the F/V converter 12 is connected to the output terminal of the wave shaping circuit 11 to receive the rectangular pulse signal 11Z. The converter 12 generates, in response to the pulse signal 11Z, a voltage $V_A$ proportional to the frequency of the pulse signal 11Z. The frequency of the pulse signal 11Z and that of the pulse signal 10Z are proportional to the frequency of engine camshaft or crankshaft rotation, so that the voltage $V_A$ is also proportional to engine rotational speed.

Figure 3:
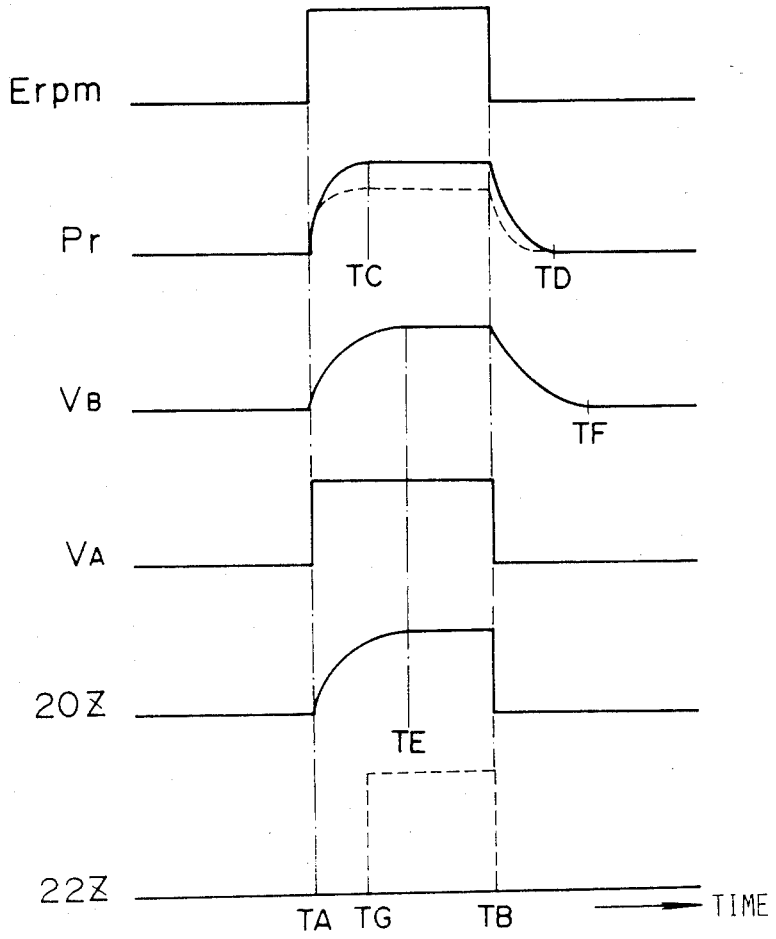
FIG. 3 is a timing chart showing exemplary changes in engine rotational speed and engine oil pressure, and various waveforms provided in the system of FIG. 1.

The input terminal of an integrating circuit 13 is connected to the output terminal of the converter 12 to receive the engine speed voltage $V_A$. The circuit 13 consists of a well-known combination of capacitors and resistors and essentially integrates the voltage $V_A$ over a preset time constant. As shown in FIG. 3, when the voltage $V_A$ abruptly increases and then abruptly decreases, the integrating circuit 13 generates a voltage pulse $V_B$ which rises at a more gradual rate and then drops at a more gradual rate. The integrating circuit 13 may be a low-pass filter or a smoothing circuit.

The input terminal of an amplitude limiter 20 is connected to the output terminal of the converter 12 via a first analog switch 15 to selectively receive the engine speed voltage $V_A$. The input terminal of the limiter 20 is also connected to the output terminal of the integrating circuit 13 via a second analog switch 16 to selectively receive the integrated voltage $V_B$. The analog switches 15 and 16 cooperate to selectively conduct one of the voltages $V_A$ and $V_B$ to the limiter 20 as will be specifically described hereinafter.

The positive input terminal of a first operational amplifier 17 is connected to the output terminal of the converter 12 via a resistor 17A to receive the engine speed voltage $V_A$. The negative input terminal of the amplifier 17 is connected to the output terminal of the integrating circuit 13 to receive the integrated voltage $V_B$. The output terminal of the amplifier 17 is connected to the positive input terminal thereof via a resistor 17B. The amplifier 17 serves as a Schmitt circuit or a comparator, producing a digital signal which is at the higher level when the voltage $V_A$ is greater than the voltage $V_B$ and which is at the lower level when the voltage $V_A$ is equal to or less than the voltage $V_B$.

The control terminal of the second analog switch 16 is connected to the output terminal of the amplifier 17 to receive the digital signal therefrom. The control terminal of the first analog switch 15 is connected to the output terminal of the amplifier 17 via an invertor 18 to receive a digital signal which is the inverse of the output of the amplifier 17. The switches 15 and 16 are conductive when voltages at their respective control terminals are at the higher level and are unconductive when the voltages are at lower level. Thus, the first switch 15 is conductive and the second switch 16 is unconductive when the voltage $V_A$ is equal to or less than the voltage $V_B$. On the other hand, the first switch 15 is unconductive and the second switch 16 is conductive when the voltage $V_A$ is greater than the voltage $V_B$. As a result, only the voltage $V_A$ is conducted to the limiter 20 when the voltage $V_A$ is equal to or less than the voltage $V_B$. On the other hand, only the voltage $V_B$ is conducted to the limiter 20 when the voltage $V_A$ is greater than the voltage $V_B$.

When the received voltage $V_A$ or $V_B$ is less than a preset limiting level, the limiter 20 conducts the related voltage $V_A$ or $V_B$ as it is. When the received voltage $V_A$ or $V_B$ is equal to or greater than the preset level, the limiter 20 generates a constant voltage equal to the preset level. In this way, the limiter 20 restricts the amplitude of the received voltage $V_A$ or $V_B$.

A fluid-pressure sensor 21 detects the pressure of engine oil in an engine lubricating system and generates a signal indicative thereof. The sensor 21 includes bellows 21A and a potentiometer 21B. The bellows 21A is connected to an oil line 30 in such a manner as to apply the pressure of engine oil in the line 30 to the inner surfaces of the bellows 21A. The outer surfaces of the bellows 21A are subjected to a constant pressure, such as atmospheric pressure, so that the bellows 21A expands as the pressure of engine oil increases. The oil line 30 connects the outlet of an oil pump 32 with engine moving parts (not shown) to transmit pressurized engine oil from the pump 32 to the engine parts. The pump 32 draws engine oil from an engine oil pan 34 and drives it toward the engine parts via the outlet. The movable or pivotal contact of the potentiometer 21B is linked to the bellows 21A in such a manner as to be pivoted as the bellows 21A expands and contracts. A preset constant voltage $V_C$ is applied across the resistor of the potentiometer 21B. Thus, the voltage at the movable contact of the potentiometer 21B varies according to the pressure of engine oil. The link between the movable contact of the potentiometer 21B and the bellows 21A is designed so that the voltage at the movable contact is proportional to the pressure of engine oil. The voltage at the movable contact is conducted to the output terminal of the sensor 21 as an oil pressure voltage 21Z. The oil pressure voltage 21Z can be adjusted by changing the preset constant voltage $V_C$.

The negative input terminal of a second operational amplifier 22 is connected to the output terminal of the sensor 21 to receive the oil pressure voltage 21Z. The positive input terminal of the amplifier 22 is connected to the output terminal of the limiter 20 to normally receive the selected voltage $V_A$ or $V_B$ as a reference voltage 20Z. The amplifier 22 serves as a Schmitt circuit or a comparator, generating a digital signal 22Z which is at the higher level when the oil pressure voltage 21Z is less than the reference voltage 20Z and which is at the lower level when the oil pressure voltage 21Z is equal to or greater than the reference voltage 20Z. The output terminal of the amplifier 22 is connected to an indicator 23, preferably a light-emitting element or display, such as a lamp, so that the amplifier 22 drives the indicator 23. The amplifier 22 energizes the indicator 23, for example, to emit light therefrom as an alarm signal only when the oil pressure voltage 21Z is less than the reference voltage 20Z.

With reference to FIG. 3, the operation of the alarm system will be described hereafter in the case where the engine rotational speed Erpm remains at a lower level before a time TA, rapidly or abruptly rises to a higher level at the time TA, remains at the higher level from the time TA to a later time TB, rapidly or abruptly returns to the lower level at the time TB, and remains at the lower level after the time TB.

The engine speed voltage $V_A$ outputted by the converter 12 varies simultaneously with the engine rotational speed Erpm. Specifically, the voltage $V_A$ abruptly rises from a lower level to a higher level at the time TA and drops from the higher to the lower level at the time TB. The voltage $V_A$ remains high from the time TA to the time TB, and remains low otherwise.

Since the oil pump 32 is driven by the engine, the oil pressure Pr detected by the sensor 21 essentially varies according to the engine rotational speed Erpm. In practice, however, variations in the oil pressure Pr have a certain time lag with respect to variations in the engine rotational speed Erpm, and the waveform of the oil pressure Pr has a component which is essentially the integral of the waveform of the engine rotational speed Erpm. Starting at the time TA and ending at a time TC between the times TA and TB, the oil pressure Pr increases at a rate which gradually decreases as time passes. The oil pressure Pr remains low before the time TA, and remains high from the time TC to the time TB. Starting at the time TB and ending at a later time TD, the oil pressure Pr drops at a rate which gradually decreases as time passes. After the time TD, the oil pressure Pr remains low.

Starting at the time TA and ending at a time TE between the times TA and TB, the integrated voltage $V_B$ rises at a rate which gradually decreases as time passes. The integrated voltage $V_B$ remains low before the time TA, and remains high from the time TE to the time TB. Starting at the time TB and ending at a later time TF, the integrated voltage $V_B$ drops at a rate which gradually decreases as time passes. In practice, the time constant of the integrating circuit 13 is chosen so that the integrated voltage $V_B$ changes slightly slower than or simultaneously with changes in the oil pressure Pr.

Before and at the time TA, since the voltages $V_A$ and $V_B$ are equal, the voltage $V_A$ is supplied to the comparator 22 via the limiter 20 as a reference voltage 20Z, provided that the voltage $V_A$ is lower than the limiting level of the limiter 20. Between the times TA and TE, since the voltage $V_B$ is lower than the voltage $V_A$, the voltage $V_B$ is supplied to the comparator 22 via the limiter 20 as a reference voltage 20Z, provided that the voltage $V_B$ is lower than the limiting level of the limiter 20. After and at the time TE, since the voltage $V_B$ is equal to or greater than the voltage $V_A$, the voltage $V_A$ is again supplied to the comparator 22 as a reference voltage 20Z, provided that the voltage $V_A$ is lower than the limiting level of the limiter 20.

The oil pressure voltage 21Z has a waveform similar to that of the oil pressure Pr. If the oil pressure Pr peaks at a lower level than normal, as shown by the broken line between the times TA and TD, the oil pressure voltage 21Z will be exceeded by the reference voltage 20Z at a time TG between the times TA and TB, will remain less than the reference voltage 20Z between the times TG and TB, and will start to exceed the reference voltage 20Z again at the time TB. In this case, the output 22Z of the comparator 22 is thus at the higher level, energizing the indicator 23, for example, to emit light as an alarm signal indicative of a harmful drop in or low level of oil pressure, between the times TG and TB, as shown by the broken line.

On the other hand, if the oil pressure Pr peaks at a normal level as shown by the solid line between the times TA and TD, the oil pressure voltage 21Z will always be greater than the reference voltage 20Z so that the output 22Z of the comparator 22 will always be at the lower level as shown by the solid line. As a result, no alarm signal will be generated by the indicator 23 in this case.

The reference voltage 20Z varies essentially with the engine rotational speed, since the voltages $V_A$ and $V_B$ depend on the engine rotational speed. Therefore, it is possible to eliminate the problem that no alarm signal is generated by the indicator 23 in response to a harmful drop in or low level of engine oil pressure resulting in an inadequate supply of engine oil in the high engine speed range, even though the engine oil pressure increases with the engine rotational speed.

The integrating circuit 13 serves to match the rate of increase of the voltage $V_B$ and thus that of the reference voltage 20Z to the normal rate of increase of the oil pressure voltage 21Z, thereby preventing the indicator 23 from erroneously producing an alarm signal due to the time lag of increases in the engine oil pressure Pr with respect to increases in the engine rotationsl speed Erpm.

In the case where the engine oil pressure is saturated in the high engine speed range, the limiter 20 is designed to restrict the reference voltage 20Z to match the maximum level of the oil pressure voltage 21Z in the high engine speed range. As a result, the indicator 23 is prevented from erroneouly generating an alarm signal due to saturation of the oil pressure Pr.

Figure 4:
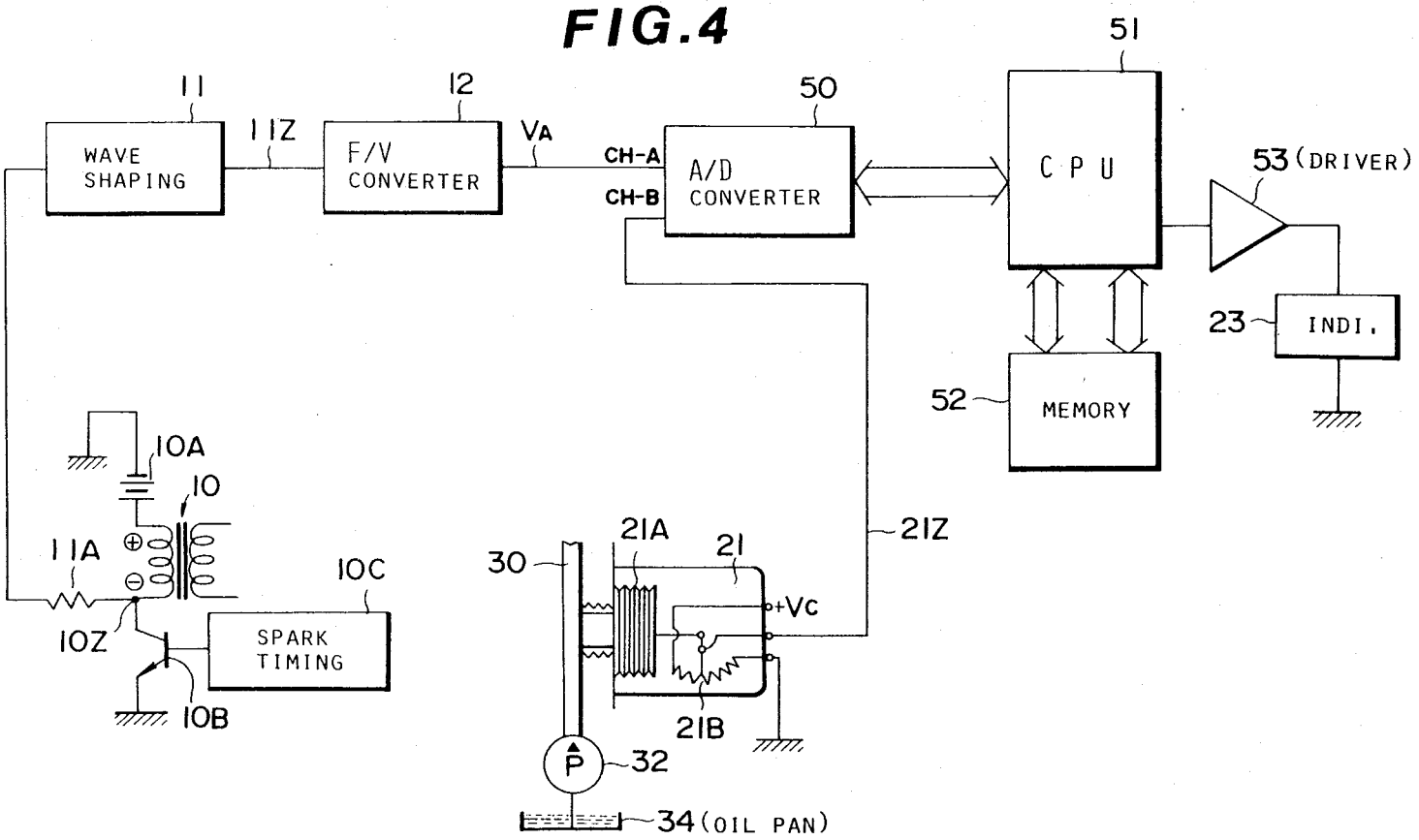
FIG. 4 is a schematic diagram of an alarm system according to a second embodiment of this invention.

FIG. 4 shows an alarm system according to a second embodiment of this invention, which includes an engine ignition coil 10, a wave shaping circuit 11, and a frequency-to-voltage (F/V) converter 12 in the same manner as that of the first embodiment. The alarm system of the second embodiment also includes a fluid-pressure sensor 21 arranged to sense the pressure in an oil line 30 in the same manner as that of the first embodiment.

The alarm system of the second embodiment further includes a digital computer system, which has an analog-to-digital (A/D) converter 50. The first input terminal or channel A of the A/D converter 50 is connected to the output terminal of the F/V converter 12 to receive the engine speed voltage $V_A$. The second input terminal or channel B of the A/D converter is connected to the output terminal of the sensor 21 to receive the oil pressure voltage 21Z. The A/D converter 50 converts the engine speed voltage $V_A$ and the oil pressure voltage 21Z to the corresponding digital signals.

The digital computer system also has a central processing unit (CPU) 51, a memory 52, and a driver 53 with output and control ports. The control port of the driver 53 is connected to the central processing unit 51, and the output port thereof is connected to an indicator 23 to energize the latter in response to a control signal from the unit 51. The indicator 23 is identical with that of the first embodiment. The memory 52 consists of a read only memory and a read/write memory. The central processing unit 51 is connected to the A/D converter 50 to receive the engine-speed and oil-pressure digital-signals. The central processing unit 51 is also connected to the memory 52. In accordance with a program stored in the memory 52, the central processing unit 51 functions to control the indicator 23 via the driver 53 in response to the engine speed and the oil pressure indicated by the engine-speed and oil-pressure digital signals from the A/D converter 50. The driver 53 and the A/D converter 50 thus constitute an input-/output circuit of the digital computer system.

Figure 5:
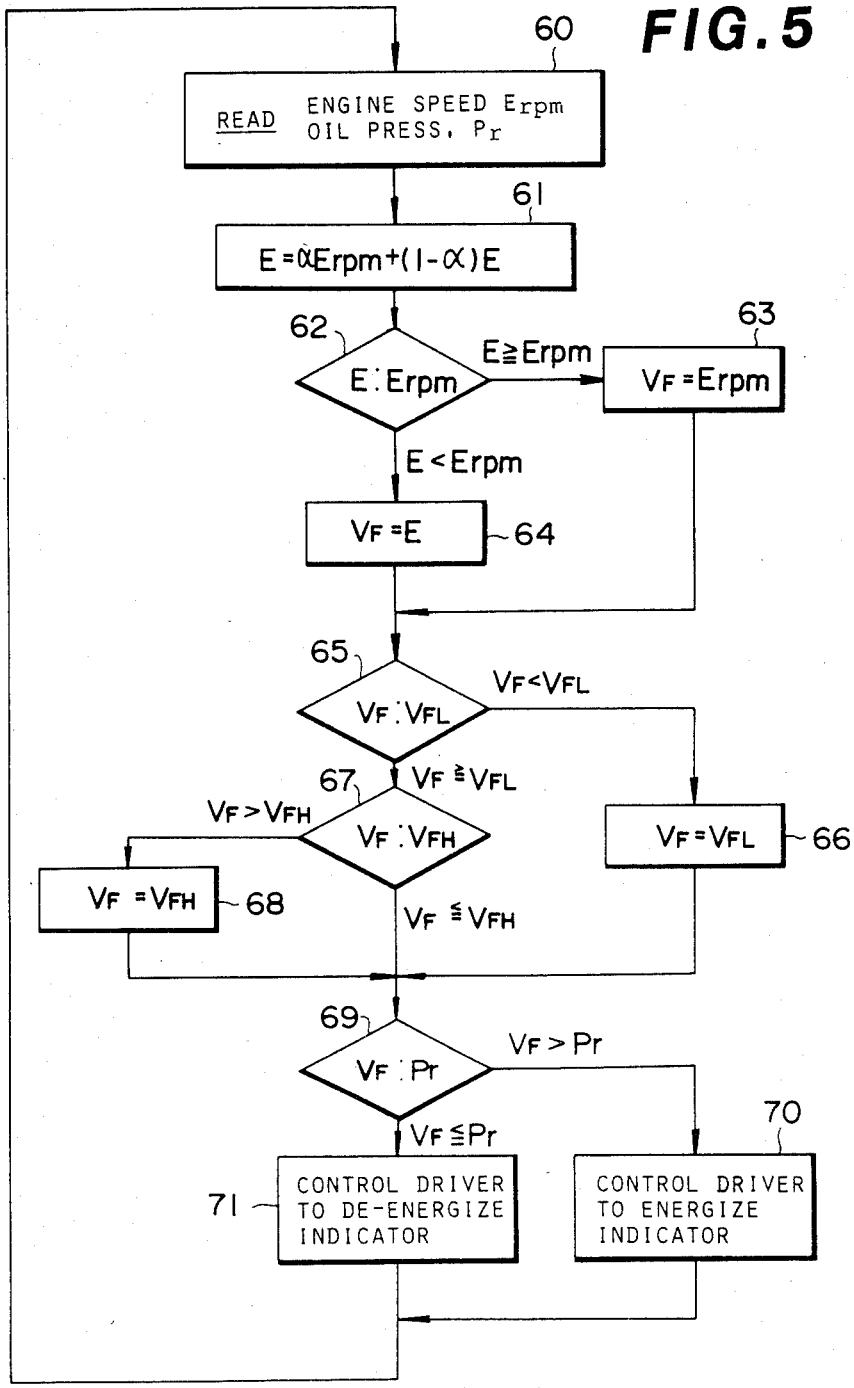
FIG. 5 is a flowchart of operation of the digital computer of FIG. 4.

FIG. 5 shows a flowchart of function of the central processing unit 51 defined by the program stored in the memory 52. In a step 60, the unit 51 reads the engine speed Erpm and the oil pressure Pr from the signals from the A/D converter 50. In a subsequent step 61, the unit 51 calculates an essential integration E of the engine speed Erpm by means of a statement "$E=\alpha\text{-}Erpm+(1-\alpha)E$", where $\alpha$ is a constant determining a time lag of the integration E with respect to the engine speed Erpm. The constant $\alpha$ is preferably chosen so that the related time lag essentially corresponds to a time lag of the oil pressure Pr with respect to the engine speed Erpm.

After the step 61, the unit 51 compares the engine speed Erpm with the integration E in a step 62. If the engine speed Erpm is equal to or less than the integration E, the unit 51 sets a variable $V_F$ equal to the engine speed Erpm in a step 63. If the engine speed Erpm is greater than the integration E, the unit 51 sets the variable $V_F$ equal to the integration E in a step 64. In this way, one of the integration E and the engine speed Erpm is selected as the variable $V_F$ in response to the comparison therebetween.

After the steps 63 and 64, the unit 51 compares the variable $V_F$ with a constant $V_{FL}$ in a step 65. If the variable $V_F$ is smaller than the constant $V_{FL}$, the unit 51 sets the variable $V_F$ equal to the constant $V_{FL}$ in a step 66. If the variable $V_F$ is equal to or greater than the constant $V_{FL}$, the unit 51 compares the variable $V_F$ with a constant $V_{FH}$ in a step 67. If the variable $V_F$ is greater than the constant $V_{FH}$, the unit 51 sets the variable $V_F$ equal to the constant $V_{FH}$ in a step 68. In this case, the constant $V_{FL}$ and $V_{FH}$ are respectively chosen to correspond to the minimum and maximum levels of the oil pressure Pr under normal conditions. Thus, the variable $V_F$ is limited to a range from the constant $V_{FL}$ to the constant $V_{FH}$.

After the steps 67 and 68, the function of the unit 51 proceeds to a step 69. If the variable $V_F$ is equal to or smaller than the constant $V_{FH}$, the function of the unit 51 also proceeds the step 69. The unit 51 compares the oil pressure Pr with the variable $V_F$ in the step 69. If the oil pressure Pr is smaller than the variable $V_F$, the unit 51 controls the driver 53 in a step 70 to make high the voltage at the output port thereof to energize the indicator 23. When energized, the indicator 23 generates an alarm signal. If the oil pressure Pr is equal to or greater than the variable $V_F$, the unit 51 controls the driver 53 in a step 71 to make low the voltage at the output port thereof to de-energize the indictor 23. When de-energized, the indicator 23 generates no alarm signal. Ultimately, the variable $V_F$ constitutes a reference for judging whether or not the level of the oil pressure Pr drops to a harmful level or is harmfully low, and therefore the variable $V_F$ essentially corresponds to the reference voltage 20Z of the first embodiment. After the steps 70 and 71, the function of the unit 51 returns to the step 60.

It should be understood that further modifications and variations may be made in this invention without departing from the spirit and scope of this invention as set forth in the appended claims.

What is claimed is:

1. An alarm system applied to engine oil pressure dependent on engine speed, comprising:

(a) means for sensing the engine oil pressure and generating a signal indicative thereof;

(b) means for sensing the engine speed and generating a signal indicative thereof;

(c) means, responsive to the engine speed signal, for generating a reference signal defining an oil pressure reference level as a function of the engine speed, said function selected to match a second function representing normal dependence of oil pressure on engine speed; and (d) means, responsive to the oil pressure signal and the reference signal, for comparing the engine oil pressure with the reference level and generating an alarm signal when the engine oil pressure is lower than the reference level, wherein:

the engine speed signal has a voltage which increases with the engine speed; and the reference signal generating means includes a first means for essentially integrating the engine speed signal to produce an integrated voltage signal, a second means for comparing the voltage of the engine speed signal to that of the integrated voltage signal, and a third means for conducting the engine speed signal to the oil-pressure/reference-level comparing means as a reference signal when the voltage of the engine speed signal is equal to or lower than that of the integrated voltage signal and conducting the integrated voltage signal to the oil-pressure/reference-level comparing means as a reference signal when the voltage of the engine speed signal is greater than that of the integrated voltage signal.

2. An alarm system as recited in claim 1, wherein the reference level increases as the engine speed increases.

3. An alarm system as recited in claim 1, wherein the reference signal generating means includes another means for causing changes in the reference level to have a preset time lag with respect to changes in the engine speed, the preset time lag corresponding to a time lag of changes in the engine oil pressure with respect to changes in the engine speed.

4. An alarm system as recited in claim 1, wherein the reference signal generating means, said oil pressure/reference level comparing means and said first, second and third means comprise a digital computer.

5. An alarm system for providing an alarm when engine oil pressure drops below a reference comprising:

(a) pulse means for producing a pulse train having a frequency proportional to engine rotational speed;

(b) frequency to voltage converting means connected to said pulse means and responsive to said pulse train for generating a voltage proportional to said frequency of said pulse train and thus proportional to the engine rotational speed;

(c) integrating means connected to an output of said converting means to receive said voltage for producing a signal representing an integral of said voltage proportional to said engine rotational speed;

(d) first comparing means connected to receive said voltage and said signal representing said integral thereof for producing an output at a first level when said voltage exceeds said signal and at a second level when said signal exceeds said voltage;

(e) minimum signal selecting means receiving said voltage, said signal, and said output of said first comparing means for providing a minimum signal corresponding to the smaller of said voltage and said signal;

(f) amplitude limiting means receiving said minimum signal provided by said minimum signal selecting means for providing a reference signal corresponding to said voltage or to said signal representing an integral thereof when said minimum signal is less than a predetermined level and corresponding to said predetermined level when said minimum signal exceeds said predetermined level;

(g) oil pressure sensing means providing a voltage representing oil pressure;

(h) second comparing means receiving said reference signal at one input and said voltage representing oil pressure at a second input for outputting an indicating signal when said reference signal exceeds said voltage representing oil pressure and (i) alarm means responsive to said indicating signal for generating an alarm in response to a condition wherein said oil pressure signal is smaller than said reference signal.

6. An alarm system as recited in claim 5 wherein said minimum signal selecting means comprises control switching means responsive to said output of said first comparing means by switching said voltage or said signal representing the integral thereof to said amplitude limiting means under control of said output of said first comparing means.

7. An alarm system as recited in claim 5 wherein said amplitude limiting means provides said reference signal at a level corresponding to a saturated oil pressure.

8. An alarm system as recited in claim 5 wherein said oil pressure sensing means and said integrating means are matched for preventing an erroneous indication of said alarm generating condition.

9. An alarm system as recited in claim 8 wherein said oil pressure sensing means is operable for producing said oil pressure voltage at a first rate of change in response to a change in engine speed and said integrating means in selected to have an integration time constant providing said integrating means with a rate of change substantially equal to or slightly lower than said rate of change of said oil pressure sensing means.

10. An alarm system for producing an alarm when engine oil pressure drops below a reference comprising:

(a) pulse means for producing a pulse train having a frequency proportional to engine rotational speed;

(b) frequency to voltage converting means connected to said pulse means and responsive to said pulse train for generating a voltage proportional to said frequency of said pulse train and thus proportional to the engine rotational speed;

(c) oil pressure sensing means providing a voltage representing oil pressure in the engine;

(d) analog to digital converting means for converting said voltage proportional to said rotational engine speed and said voltage representing oil pressure to digital signals;

(e) digital computer means including:

(i) programmable central processing means, (ii) storage means; and (iii) output means controlled by said central processing means;

(f) indicator means responsive to said output means for indicating a low oil pressure condition occurring when oil pressure sensed by said oil pressure sensing means is below a speed dependent reference;

(g) said programmable central processing means programmed for integrating the digital signal representing engine speed with a time lag substantially corresponding to a time lag of oil pressure changes with respect to engine speed changes;

(h) said programmable central processing means programmed for setting a variable to the lower of engine speed and the integrated value thereof;

(i) said programmable central processing means further programmed for comparing said variable with first and second constants representing minimum and maximum values of oil pressure under normal conditions and defining a range of oil pressure variation;

(j) said programmable central processing means further programmed for setting the variable to said second constant if said variable exceeds said range and for setting the variable to said first constant if said range exceeds said variable;

(k) said programmable central processing means further programmed for comparing said variable with said digital signal representing said oil pressure;

(l) said programmable central processing means further programmed for providing a signal to said output means, if said variable exceeds said digital signal representing said oil pressure, to energize said indicating means to indicate a low oil pressure condition; and (m) said programmable central processing means further programmed for providing a signal to said output means, if said digital signal representing said oil pressure exceeds said variable, for deenergizing said indicating means.

11. In a method for energizing an indicator to indicate a low oil pressure condition, the improvement comprising the steps of:

determining a speed dependent reference value for comparison with a detected oil pressure, and energizing said indicator in accordance with said comaprison, said determining step comprising the further steps of detecting engine speed;

integrating said engine speed;

providing an initial value for said reference as the lower of said engine speed and said integrated engine speed values; and comparing said reference value with said detected oil pressure.

12. The method recited in claim 11 wherein said determining step comprises the further steps of:

comparing said initial value of said reference with range limits for a range of oil pressure and setting said reference value to one of said limits if said initial value is outside said range and to said initial value if said initial value is within said range.

* * * * *